US010731575B2

(12) United States Patent
Sugie et al.

(10) Patent No.: US 10,731,575 B2
(45) Date of Patent: Aug. 4, 2020

(54) FUEL PUMP CONTROL SYSTEM

(71) Applicant: DENSO CORPORATION, Kariya, Aichi-pref. (JP)

(72) Inventors: Takuya Sugie, Kariya (JP); Makoto Asai, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/431,051

(22) Filed: Jun. 4, 2019

(65) Prior Publication Data

US 2020/0095948 A1 Mar. 26, 2020

(30) Foreign Application Priority Data

Sep. 25, 2018 (JP) ..... 2018-179063

(51) Int. Cl.

| | |
|---|---|
| ***F02M 65/00*** | (2006.01) |
| ***F02D 41/22*** | (2006.01) |
| ***F02D 33/00*** | (2006.01) |
| ***F02D 1/02*** | (2006.01) |

(52) U.S. Cl.

CPC ..... *F02D 33/003* (2013.01); *F02D 1/025* (2013.01); *F02D 41/221* (2013.01); *F02M 65/003* (2013.01); *F02D 2041/224* (2013.01); *F02D 2200/0602* (2013.01)

(58) Field of Classification Search

CPC ..... F02D 33/003; F02D 41/221; F02D 2041/224; F02D 2200/0602; F02D 2200/0604; F02D 2200/0625; F02M 65/003

USPC ..... 701/103, 107, 112; 123/479, 690; 73/114.41, 114.42, 114.43

See application file for complete search history.

(56) References Cited

U.S. PATENT DOCUMENTS

| | | | | |
|---|---|---|---|---|
| 5,749,344 | A | 5/1998 | Yoshiume et al. | |
| 2009/0306873 | A1* | 12/2009 | Rogers | F02D 33/003 701/101 |
| 2013/0013174 | A1* | 1/2013 | Nistler | F02D 41/123 701/112 |
| 2013/0013175 | A1* | 1/2013 | Nistler | F02D 41/22 701/112 |
| 2013/0213123 | A1* | 8/2013 | Ghoneim | F02D 41/22 73/114.41 |

* cited by examiner

*Primary Examiner* — Erick R Solis
(74) *Attorney, Agent, or Firm* — Posz Law Group, PLC

(57) ABSTRACT

A lower limit setting portion of a fuel pump control system sets a lower limit value depending on an engine operating mode. For example, it sets a duty ratio of 0% as the lower limit value, when the engine operating mode is in a STOP mode in a turned-on condition of an ignition switch. A duty-ratio calculating portion carries out a feedback control in order that an actual fuel pressure comes closer to a target fuel pressure by use of the lower limit value and calculates a duty ratio for driving a fuel pump by the feedback control. An abnormal condition determining portion determines an abnormal condition based on the duty ratio and pump current. The abnormal condition determining portion further determines based on a remaining fuel amount whether the abnormal condition is caused by a disconnection or whether the abnormal condition is caused by an idling operation of the fuel pump due to fuel shortage.

8 Claims, 5 Drawing Sheets

FUEL PUMP CONTROL SYSTEM

CROSS REFERENCE TO RELATED APPLICATION

This application is based on Japanese Patent Application No. 2018-179063 filed on Sep. 25, 2018, the disclosure of which is incorporated herein by reference.

FIELD OF TECHNOLOGY

The present disclosure relates to a fuel pump control system to be used in an automotive vehicle.

BACKGROUND

A fuel pump control system or device is known in the art, according to which fuel is supplied by a fuel pump from a fuel tank of an automotive vehicle to an internal combustion engine.

In one of the fuel pump control systems, electric power is supplied from a vehicle battery to the fuel pump control system via a relay device so that the fuel pump control system is operated. An on-off operation of the relay device is controlled by an engine control unit (an engine ECU). When an operation of the internal combustion engine (an engine operation) is going to be stopped, the relay device is turned off by a control signal from the engine ECU to stop an operation of the fuel pump (a pump operation).

In an automotive vehicle having an idling-stop function, the relay device is turned off during an engine stopped period, in which the engine operation is temporarily stopped as an idling-stop operation. In a hybrid vehicle having an internal combustion engine and an electric motor as a vehicle driving device, the relay device is turned off in a vehicle running period of an EV running mode. As above, the relay device is turned off to stop the pump operation in a condition that an ignition switch is turned on, when the engine operation is temporarily stopped during a vehicle running operation. As a result, an on-off operation of the relay device is repeatedly done.

The fuel pump may run idle when fuel becomes insufficient. When the relay device is turned on during the temporal engine stopped period in the vehicle running operation, the fuel pump may run idle in a case of shortage of the fuel. Then, the fuel pump control system may erroneously determine that an abnormal condition is caused by a disconnection in a power supply path, through which the electric power is supplied from the vehicle battery to the fuel pump via the relay device, in spite that the fuel pump is running idle due to the shortage of the fuel.

SUMMARY OF THE DISCLOSURE

It is an object of the present disclosure to provide a fuel pump control system, according to which number of on-off operations of a relay device for the fuel pump control system can be reduced and an idling operation of the fuel pump due to shortage of fuel can be detected.

According to one of features of the present disclosure, an electronic control unit of a fuel pump control system determines whether there is an abnormal condition for a fuel pump or not, based on a duty ratio of a driving signal for the fuel pump and a driving current for the fuel pump. The electronic control unit further determines based on a remaining fuel amount in a fuel tank whether the abnormal condition is caused by a disconnection in a power supply path or whether the abnormal condition (an idling operation of the fuel pump) is caused by shortage of fuel in the fuel tank.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION OF THE EMBODIMENTS

Figure 1:
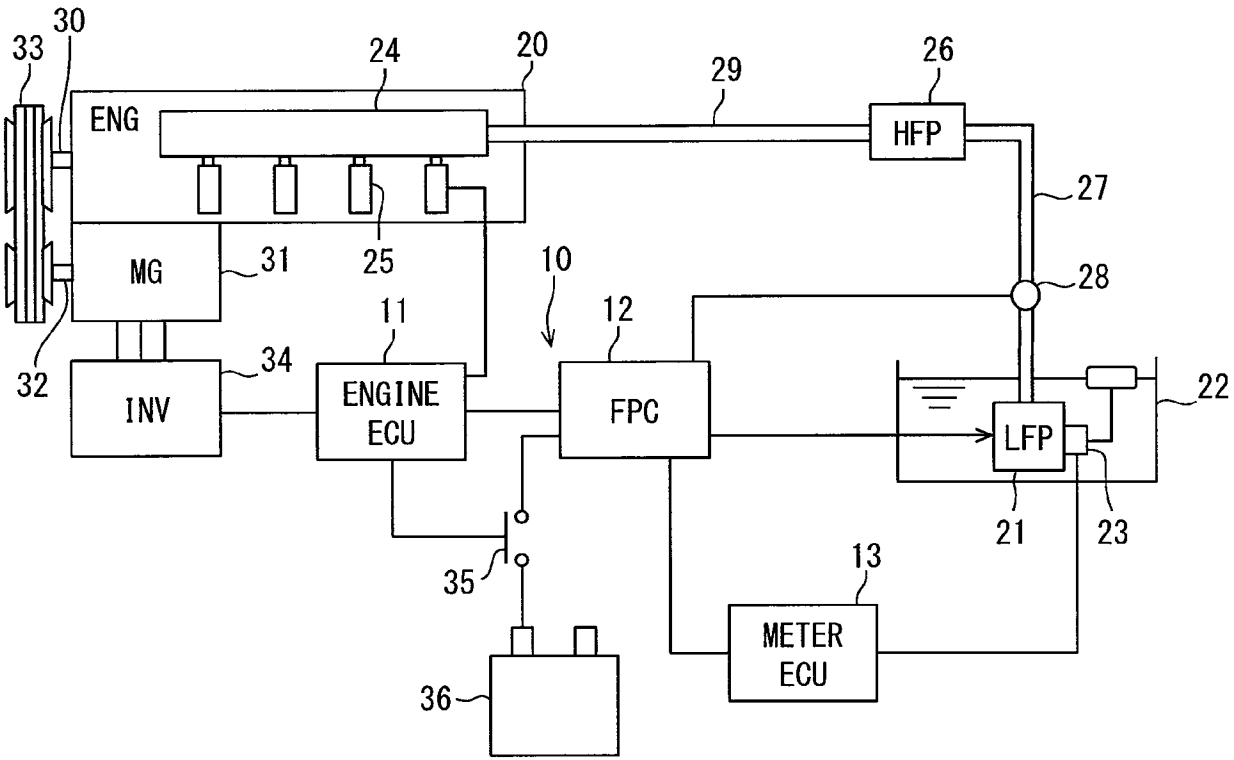
FIG. 1 is a schematic diagram showing a structure of a fuel supply system according to an embodiment of the present disclosure.

The present disclosure will be explained hereinafter by way of multiple embodiments and/or modifications with reference to the drawings. The same reference numerals are given to the same or similar structures and/or portions in order to avoid repeated explanation.

Embodiment

A structure of a fuel supply system 10 according to an embodiment of the present disclosure will be explained with reference to FIG. 1.

An engine control system including the fuel supply system 10 is shown in FIG. 1, in which fuel supply to an internal combustion engine 20 (hereinafter, the engine 20) is controlled by the fuel supply system 10. The engine 20 is mounted in an automotive vehicle (not shown) having an idling-stop function.

The fuel supply system 10 includes an electronic control unit 11 (hereinafter, the engine ECU 11) and a fuel pump controller 12 (hereinafter, the FPC 12) for controlling a fuel pump 21 of a low-pressure type (hereinafter, the low-pressure pump 21), wherein fuel is supplied by the low-pressure pump 21 from a fuel tank 22 to the engine 20. In the present disclosure, the FPC 12 corresponds to a fuel pump control system or device, while the low-pressure pump 21 corresponds to a fuel supply pump.

The low-pressure pump 21 is arranged in the fuel tank 22. A fuel sensor 23 is provided in the fuel tank 22 for detecting a remining fuel amount in the fuel tank 22. The fuel sensor 23 includes a floating member and so on. The fuel sensor 23 is also called as a liquid-level sensor. A detection signal of the fuel sensor 23 is outputted to an electronic control unit 13 for meters (hereinafter, the meter ECU 13). The meter ECU 13 outputs a fuel warning signal of a high-level signal, when the remaining fuel amount becomes lower than a predetermined value. Then, a fuel warning lump of the automotive vehicle is turned on.

The low-pressure pump 21, which is electrically operated, draws the fuel in the fuel tank 22 and pressurizes the fuel to a relatively low pressure, such as, 0.3 Mpa. Then, the low-pressure pump 21 discharges the pressurized fuel to a fuel delivery pipe 24 of the engine 20. The fuel delivery pipe 24 is connected to each of fuel injection valves 25 for injecting the fuel to each of combustion chambers of the engine 20.

A fuel pump 26 of a high-pressure type (hereinafter, the high-pressure pump 26) is provided between the low-pressure pump 21 and the fuel delivery pipe 24. The low-pressure pump 21 and the high-pressure pump 26 are connected to each other via a low-pressure fuel pipe 27. The low-pressure pump 21 pumps out the fuel to the low-pressure fuel pipe 27. A fuel pressure sensor 28 is provided in the low-pressure fuel pipe 27 for detecting fuel pressure of the fuel discharged from the low-pressure pump 21.

The high-pressure pump 26 is connected to the fuel delivery pipe 24 via a high-pressure fuel pipe 29. The high-pressure pump 26 pressurizes the fuel from the low-pressure fuel pipe 27 to a relatively high pressure, for example, to a value of 3.0 MPa, and pumps out the fuel to the fuel delivery pipe 24 via the high-pressure fuel pipe 29. The high-pressure pump 26 is connected to a crankshaft 30 of the engine 20, so that the high-pressure pump 26 is operated by the engine 20.

A motor generator 31 (hereinafter, the MG 31) is integrally provided to the engine 20. The MG 31 is an electric rotating machine operating as an electric motor and an electric power generator. A rotating shaft 32 of the MG 31 is connected to the crankshaft 30 of the engine 20 via a belt 33. When starting an operation of the engine 20, an initial rotation (a cranking rotation) is applied to the engine 20 by rotation of the MG 31.

The MG 31 is connected to a vehicle battery 36 via an inverter 34, which is an electric power converting circuit. When the MG 31 is operated as the electric motor, direct electric current from the vehicle battery 36 is converted into alternating current (three-phase alternating current) by the inverter 34. On the other hand, when the MG 31 is operated as the electric power generator, electric power generated at the MG 31 is converted from the alternating current to the direct current and then charged into the vehicle battery 36. The MG 31 is also called as an integrated starter generator (ISG).

The engine ECU 11 carries out various kinds of vehicle controls based on vehicle running information including information of an engine operation, which is detected by various kinds of sensors (not shown). The vehicle controls include an opening control of a throttle valve, a fuel injection control by the fuel injection valves 25, an engine control including an ignition control, an inverter control of the inverter 34 and so on. The sensors include a crank angle sensor, a cam angle sensor, an air-fuel ratio sensor (an A/F sensor), a vehicle speed sensor, a brake sensor, an acceleration pedal sensor, an intake-air temperature sensor, a pressure sensor, an air-flow sensor, a sensor for engine cooling-water and so on.

The engine ECU 11 carries out an idling-stop control for the engine 20. The engine ECU 11 stops the operation of the engine 20, when a condition for the idling-stop control (hereinafter, the idling-stop condition) is satisfied. The engine ECU 11 re-starts the operation of the engine 20, when a condition for an engine-restarting operation (hereinafter, the engine-restart condition) is satisfied. For example, the idling-stop condition is satisfied, when a vehicle speed is lower than a predetermined value and a braking operation is done. The engine-restart condition is satisfied, when an acceleration operation is started.

The engine ECU 11 sets a target fuel pressure based on the vehicle running information and outputs a control signal for the target fuel pressure. In addition, in the present embodiment, the engine ECU 11 outputs a signal for an engine operating mode (hereinafter, the engine mode signal) indicating an operating condition of the engine 20. The engine operating mode includes, for example, a RUN mode (an engine running condition), a STOP mode (an engine stopped condition), and a CRANK mode (an engine cranking condition). The engine ECU 11 outputs a STOP-mode signal, when an ignition switch (not shown) is in a turned-on condition. Namely, the STOP-mode signal indicates that the engine operation is temporarily stopped during the automotive vehicle is traveling. As above, the engine ECU 11 outputs the STOP-mode signal, when the idling-stop condition is satisfied.

The engine ECU 11 includes a micro-computer as a main component. The micro-computer is composed of a CPU, a ROM, a RAM, a register, I/O ports and so on. However, functions and/or means provided by the engine ECU 11 can be alternatively provided by a computer for carrying out programs memorized in a memory device, a software, a hardware, or a combination of the software and the hardware. For example, when the engine ECU 11 is structured by the hardware (electronic circuits), the engine ECU 11 is composed of digital circuits and/or analog circuits having multiple logic circuits.

Electric power is supplied from the vehicle battery 36 (the electric power source for the direct current) to the FPC 12, when a relay device 35 is turned on. The relay device 35 is composed of, for example, a mechanical type relay. An on-off operation of the relay device 35 is controlled by the engine ECU 11. The engine ECU 11 turns on the relay device 35 when the ignition switch (not shown) is turned on, while the engine ECU 11 turns off the relay device 35 when the ignition switch is turned off. In addition, the engine ECU 11 maintains a turned-on condition of the relay device 35, when the engine operation is temporarily stopped in a condition that the ignition switch is in the turned-on condition, namely, in an idling-stop operation of the engine 20.

The engine ECU 11, the FPC 12 and the meter ECU 13 are in communication with one another. In the present embodiment, the engine ECU 11, the FPC 12 and the meter ECU 13 are connected to one another via a communication bus of an in-vehicle network system (based on CAN=Controller Area Network), so that they communicate with one another via a CAN system.

The FPC 12 receives the control signal for the target fuel pressure from the engine ECU 11 via the communication bus, while the FPC 12 receives information for actual fuel pressure from the fuel pressure sensor 28. The FPC 12 carries out a feedback control (for example, PI control) in order that the actual fuel pressure comes closer to the target fuel pressure. The FPC 12 calculates a duty ratio for a pump driving signal (a first duty ratio "R0"; explained below) for the feedback control. The FPC 12 outputs the pump driving signal having a predetermined duty ratio to control an operation of the low-pressure pump 21. The FPC 12 drives an electric motor (not shown) of the low-pressure pump 21. More details for the FPC 12 will be explained below.

Structure of FPC

Figure 2:
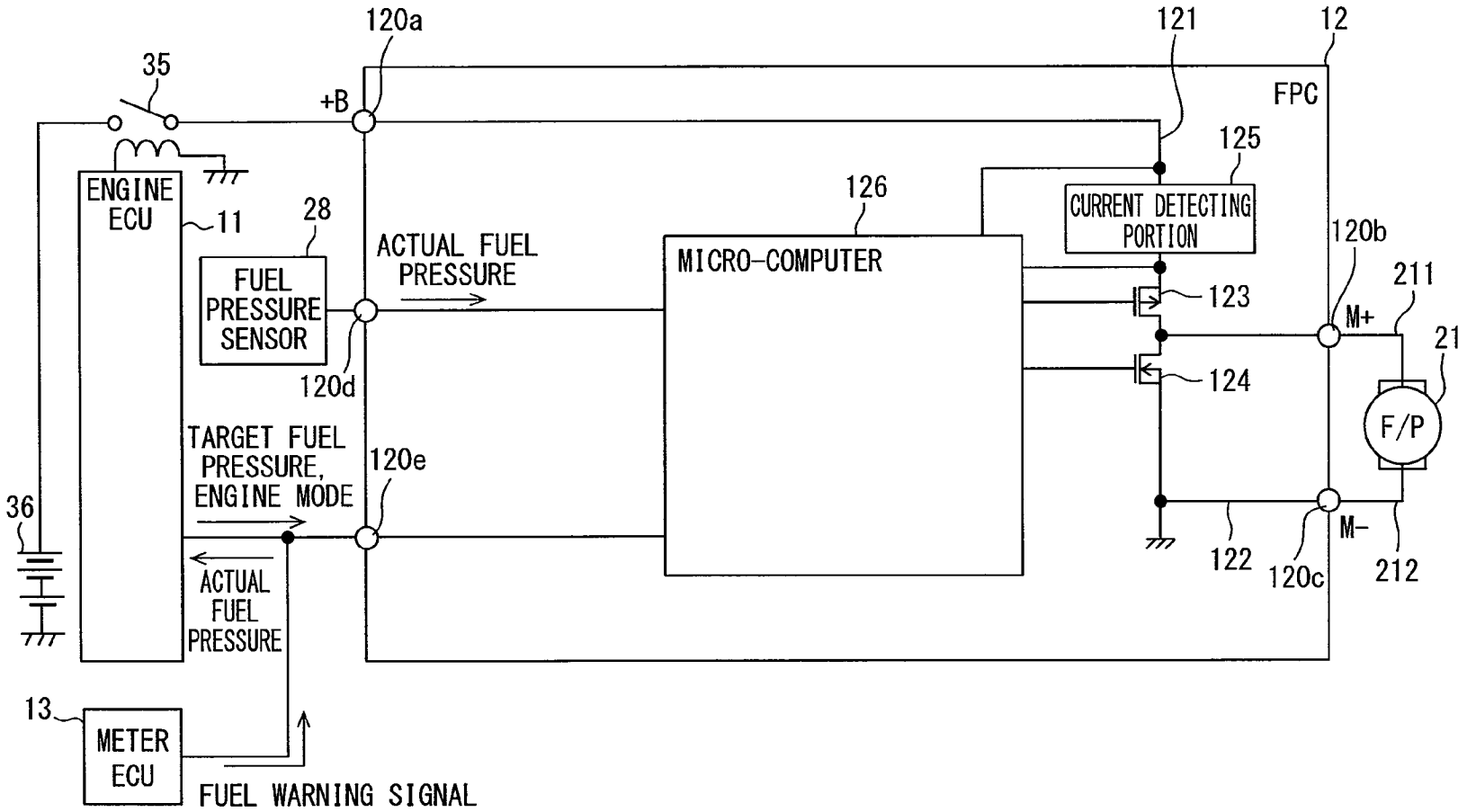
FIG. 2 is a schematic diagram showing a structure of a fuel pump controller (FPC) of the fuel supply system.

FIG. 2 schematically shows a structure of the FPC 12. The FPC 12 has multiple terminals 120*a* to 120*e*. The terminal

120*a*, which is also referred to as a "+B" terminal, is connected to a plus terminal of the vehicle battery 36 via the relay device 35. The terminal 120*b* (an "M+" terminal) is connected to one of terminals of the low-pressure pump 21, while the terminal 120*c* (an "M−" terminal) is connected to the other terminal of the low-pressure pump 21. A power supply line 121 between the terminals 120*a* and 120*b*, a load line 211 between the terminal 120*b* and the low-pressure pump 21, another load line 212 between the low-pressure pump 21 and the terminal 120*c*, and another power supply line 122 between the terminal 120*c* and the ground form a power supply path for supplying the electric power from the vehicle battery 36 to the low-pressure pump 21.

The terminal 120*d* is a sensor terminal to be connected to the fuel pressure sensor 28. The actual fuel pressure detected by the fuel pressure sensor 28 is inputted to the FPC 12 via the terminal 120*d*. The terminal 120*e* is a communication terminal connected to the CAN system. Although not shown in FIG. 2, the communication terminal 120*e* includes a high-level terminal and a low-level terminal. The control signal for the target fuel pressure, which is produced in the engine ECU 11, is inputted to the FPC 12 via the communication terminal 120*e*. In addition, the fuel warning signal produced in the meter ECU 13 is inputted to the FPC 12 via the communication terminal 120*e*. The information for the actual fuel pressure, which is inputted from the fuel pressure sensor 28 to the FPC 12, is further outputted to the engine ECU 11 via the communication terminal 120*e*.

The FPC 12 includes a switching element 123, a regeneration element 124, a current detecting portion 125 and a micro-computer 126, in addition to the terminals 120*a*-120*e*.

The switching element 123 is provided in the power supply path. In other words, the switching element 123 is connected in series with the low-pressure pump 21. The switching element 123, which is a device for driving the low-pressure pump 21, is arranged at a high-level side of the low-pressure pump 21. The switching element 123 is provided in the power supply line 121. The switching element 123 is composed of a MOSFET of a p-channel type. A drain of the MOSFET is connected to the "M+" terminal 120*b*.

The regeneration element 124, which is composed of a MOSFET of an n-channel type, is provided between the power supply line 122 and the drain of the switching element 123. The regeneration element 124 is operated by a synchronous rectification system, so that the regeneration element 124 and the switching element 123 are alternately turned on. The regeneration element 124 is not limited to a switching device. A diode may be used as the regeneration element 124.

The current detecting portion 125 detects a pump current flowing through the low-pressure pump 21. The current detecting portion 125 is composed of, for example, a shunt resistor (not shown) provided between the power supply lines 121 and 122. In the present embodiment, the current detecting portion 125 is provided at a high-level side of the switching element 123.

The micro-computer 126 (hereinafter, the computer 126) is composed of a CPU, a ROM, a RAM, a register, I/O ports and so on. The computer 126 calculates the first duty ratio "R0" based on the target fuel pressure, the actual fuel pressure and a lower limit value for the duty ratio. The computer 126 calculates the lower limit value for the first duty ratio "R0" depending on the engine operating mode. The computer 126 calculates the first duty ratio "R0" for the feedback control in such a way that the first duty ratio "R0" does not become lower than the lower limit value.

As will be explained below more in detail with reference to FIG. 3, the computer 126 determines whether the low-pressure pump 21 is running idle due to shortage of the fuel or whether there is a wire disconnection in the power supply path including the power supply lines 121 and 122 and the load lines 211 and 212, based on a detected current value "Ip" (hereinafter, the pump current "Ip"), the first duty ratio "R0" and the fuel warning signal for the remaining fuel amount. The FPC 12 sets a second duty ratio "R1" depending on the above determination and outputs the pump driving signal having the second duty ratio "R1" as set above. The on-off operation of the switching element 123 is controlled by the pump driving signal.

Process Executed by FPC

Figure 3:
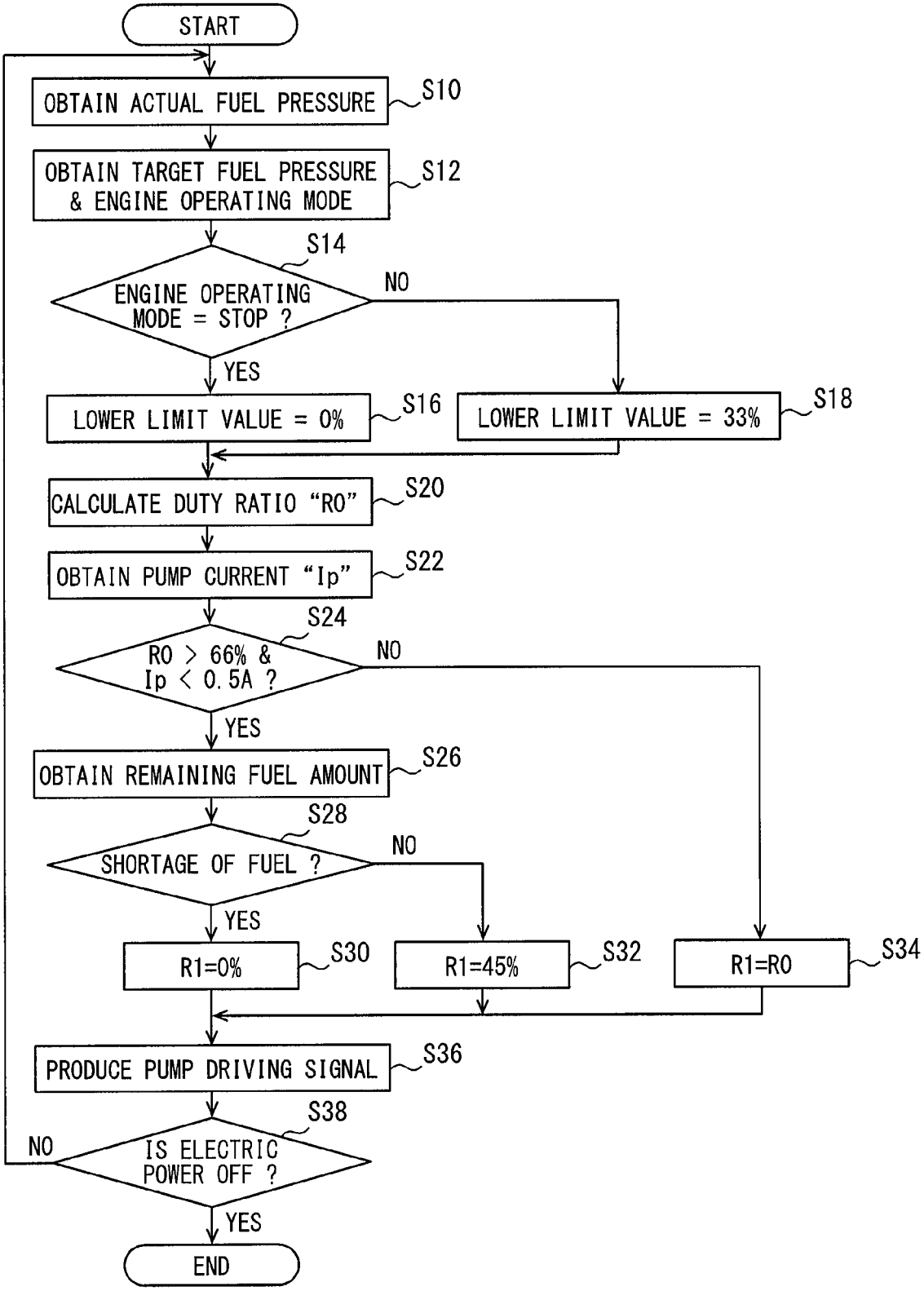
FIG. 3 is a flowchart showing a process to be carried out by a micro-computer of the FPC.

FIG. 3 is a flowchart showing a process to be carried out by the computer 126 of the FPC 12. As explained above, the engine ECU 11 turns on the relay device 35, when the ignition switch is switched on. When the relay device 35 is turned on, the electric power is supplied from the vehicle battery 36 to the FPC 12 via the "+B" terminal 120*a*, so that the computer 126 starts its process. More exactly, battery voltage (for example, 13V) is decreased by a device or a circuit (not shown) to a predetermined voltage (for example, 5V) and such a decreased voltage is applied to the computer 126. The decreased voltage is also applied to the fuel pressure sensor 28 via a power supply terminal (not shown) of the FPC 12.

As shown in FIG. 3, at a step S10, the computer 126 obtains at first the information for the actual fuel pressure in the low-pressure fuel pipe 27. The computer 126 obtains the detection signal of the fuel pressure sensor 28 via the sensor terminal 120*d*, as the actual fuel pressure.

Then, the computer 126 obtains the information for the target fuel pressure and the information for the engine condition (the engine operating mode) at a step S12. The computer 126 obtains the information for the target fuel pressure and the information for the engine condition from the engine ECU 11 via the communication terminal 120*e*.

At a step S14, the computer 126 determines whether the engine operating mode is in the STOP mode or not. For example, the engine operating mode is in the STOP mode, when the idling-stop condition is satisfied.

In a case of YES at the step S14 (the engine operating mode is in the STOP mode), the computer 126 sets "0%" as the lower limit value for the first duty ratio "R0", at a step S16. In the present embodiment, the operation of the low-pressure pump 21 is stopped when the duty ratio of the pump driving signal becomes "0%". In a case of NO at the step S14 (the engine operating mode is not in the STOP mode), the computer 126 sets "33%" as the lower limit value for the first duty ratio "R0", at a step S18.

The lower limit value for the duty ratio to be set at the step S18 is not limited to "33%". Any value, which is higher than the lower limit value set at the step S16, may be set as the lower limit value for the duty ratio at the step S18, so that the low-pressure pump 21 operated with the duty ratio of the lower limit value (33%) is not stopped. In the present embodiment, the duty ratio of "0%" is set as the lower limit value only in an engine stopped period, while the duty ratio of "33%" is set as the lower limit value in other engine operating periods than the engine stopped period.

After the lower limit value for the duty ratio is set as above, the process goes to a step S20 to calculate the first duty ratio "R0". The computer 126 carries out the feedback control (for example, PI control) by use of the lower limit value set at the step S16 or S18, so that the actual fuel pressure obtained at the step S10 comes closer to the target fuel pressure obtained at the step S12. The computer 126 calculates the first duty ratio "R0" of the pump driving signal for the above feedback control. More exactly, the computer 126 calculates the first duty ratio "R0" by the PI control, so that the first duty ratio "R0" does not become lower than the lower limit value (for example, 33%).

At a step S22, the computer 126 obtains the pump current "Ip" flowing through the low-pressure pump 21. Then, at a step S24, the computer 126 determines based on the first duty ratio "R0" and the pump current "Ip" whether there exists an abnormal condition or not. Namely, the computer 126 determines whether there is either one of the abnormal conditions, that is, the abnormal condition in which the low-pressure pump 21 is running idle due to the shortage of the fuel or the abnormal condition in which the disconnection occurs in the power supply path. The computer 126 determines that there exists the abnormal condition, when the first duty ratio "R0" is larger than a duty-ratio threshold value (for example, 66%) and the pump current "Ip" is smaller than a current threshold value (for example, 0.5 A).

In a case of YES at the step S24 (when either one of the abnormal conditions exists), the computer 126 obtains the information relating to the remaining fuel amount at a step S26. Then, at a step S28, the computer 126 determines whether the fuel becomes insufficient and thereby the automotive vehicle is running out of gas or not. In the present embodiment, the computer 126 receives the fuel warning signal relating to the information for the remaining fuel amount from the meter ECU 13 via the CAN communication. The computer 126 determines based on the fuel warning signal whether the fuel runs short or not. When the remaining fuel amount is larger than a predetermined value, the fuel warning signal is outputted as a low-level signal. On the other hand, when the remaining fuel amount is smaller than the predetermined value, the fuel warning signal is outputted as the high-level signal. The computer 126 determines that the fuel runs short, when the fuel warning signal is in the high-level signal.

In a case of YES at the step S28 (when it is determined that the fuel runs short, namely, it is determined that the low-pressure pump 21 runs idle), the process goes to a step S30 at which the computer 126 sets "0%" as the second duty ratio "R1", so that the operation of the low-pressure pump 21 is terminated. On the other hand, in a case of NO at the step S28 (when it is determined that the fuel does not run short but determined that there is the abnormal condition of the disconnection), the process goes to a step S32, at which the computer 126 sets a predetermined value (for example, "45%") as the second duty ratio "R1". In a case of NO at the step S24 (when it is determined that there is no abnormal condition), the process goes to a step S34, at which the computer 126 sets the first duty ratio "R0" calculated at the step S20 as the second duty ratio "R1".

At a step S36, the computer 126 produces the pump driving signal based on the second duty ratio "R1" set at the step S30, S32 or S34. The pump driving signal is outputted from the computer 126 to the switching element 123. Since the regeneration element 124 is also composed of the switching element in the present embodiment, the pump driving signal is also outputted to the regeneration element 124. In the case that the second duty ratio "R1" is set at "0%" in the step S30, the operation of the low-pressure pump 21 is terminated. In other words, the situation that the low-pressure pump 21 runs idle due to the fuel shortage is terminated (or avoided). In the case that the second duty ratio "R1" is set at "45%" in the step S32, the actual operation of the low-pressure pump 21 is not carried out due to the disconnection, although the pump driving signal having the duty ratio "45%" is outputted from the computer 126. In the case of no abnormal condition (NO at the step S24), the low-pressure pump 21 is operated by the pump driving signal having the second duty ratio "R1" (equal to the first duty ratio "R0").

At a step S38, the computer 126 determines whether the electric power supply is in an off-condition or not. In a case of YES at the step S38 (when the power supply is cut off), the process goes to an end. In a case of NO (when the power supply is continuously done), the process goes back to the step S10 to repeatedly carry out the above steps S10 to S38.

In the present embodiment, the steps S10, S12, S22 and S26 form an information obtaining portion. The steps S14, S16, S18 and S20 form a calculation portion. The steps S14, S16 and S18 form a lower-limit value setting portion. The step S20 forms a duty-ratio calculating portion. The steps S24 and S28 form an abnormal condition determining portion. The steps S30, S32 and S34 form a duty-ratio setting portion.

Advantages of FPC

Figure 4:
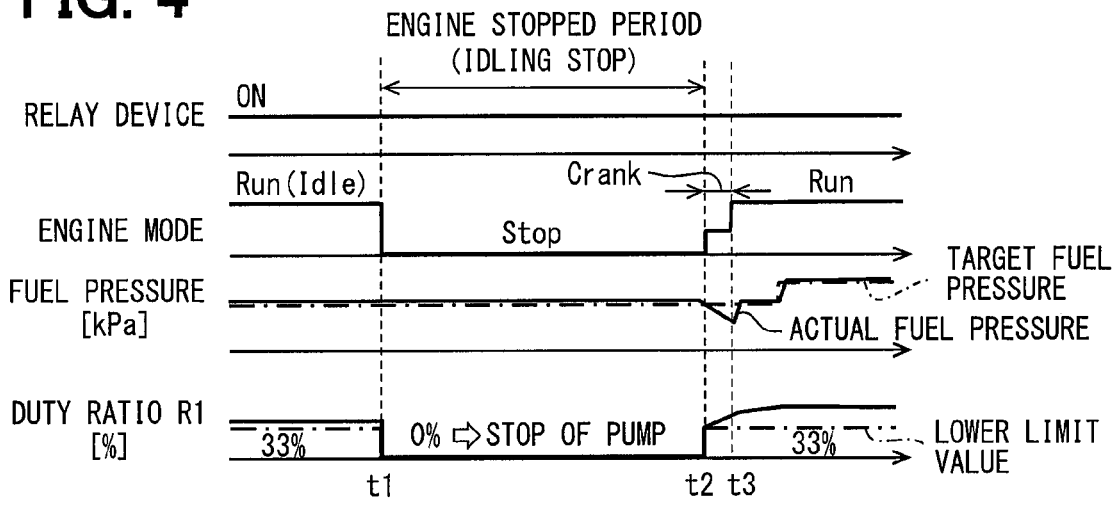
FIG. 4 is a timing chart showing an operation of a relay device as well as operational changes of related parameters in a period including an engine stopped period by an idling-stop operation.

FIG. 4 is a timing chart showing an operating condition of the relay device 35 as well as operating conditions of related portions of the FPC 12 during the engine-stopped period of the idling-stop operation. More exactly, FIG. 4 shows the operating conditions in a case that the computer 126 determines at the step S24 of FIG. 3 that there is no abnormal condition (NO at the step S24), namely in the case that the first duty ratio "R0" calculated in the step S20 is set as the second duty ratio "R1" in the step S34. FIG. 4 respectively shows the operating condition of the relay device 35, the engine operating condition (the engine operating mode), the fuel pressure and the second duty ratio "R1".

In a part of FIG. 4 for the fuel pressure, a solid line indicates the actual fuel pressure, while a one-dot-chain line indicates the target fuel pressure. In a part of FIG. 4 for the second duty ratio "R1", the second duty ratio "R1" is indicated by a solid line, while the lower limit value is indicated by a one-dot-chain line. In a part of FIG. 4 for the engine operating mode, an engine idling condition is indicated by "Run(Idle)", while a normal engine operating condition is indicated by "Run". "Stop" indicates the "STOP" mode of the engine operating condition, while "Crank" indicates the "CRANK" mode of the engine operating condition.

The engine operating mode is changed from "Run(Idle)" to "Stop" at a timing "t1", at which the idling-stop condition is satisfied. Then, the lower limit value is changed from "33%" to "0%". Since the engine operation is temporarily stopped in the engine-stopped period of the idling-stop operation from the timing "t1" to a timing "t2", the second duty ratio "R1" for the pump driving signal is correspondingly changed to "0%". The pump operation of the low-pressure pump 21 is thereby stopped. In the example shown in FIG. 4 (no abnormal condition), the actual fuel pressure does not become lower than the target fuel pressure during the engine-stopped period. Therefore, the second duty ratio "R1" is set at the value of "0%" during the engine-stopped period of the idle-stop operation.

When the condition for re-starting the engine operation is satisfied at the timing "t2", the engine operating mode is changed from "Stop" to "Crank". Then, the lower limit value is changed from "0%" to "33%", so that the second duty ratio "R1" does not become lower than "33%". In other words, the low-pressure pump 21 is operated with the second duty ratio "R1" higher than the lower limit value of "33%". Since the actual fuel pressure is decreased in a cranking operation, the second duty ratio "R1" is increased. At a timing "t3", when the cranking operation is finished, the engine operating mode is changed from "Crank" to "Run".

In the present embodiment, the engine ECU 11 outputs not only the signal for the target fuel pressure but also the signal for the engine operating mode. The computer 126 of the FPC 12 calculates a predetermined duty ratio (for example, 0%) as the first duty ratio "R0" for terminating the pump operation of the low-pressure pump 21, when the signal for the engine operating mode indicates the "STOP" mode and when the ignition switch is in the turned-on condition.

More exactly, the computer 126 calculates the lower limit value for the duty ratio for the pump driving signal depending on the engine operating mode. When the engine operating mode is in the "STOP" mode, the computer 126 calculates "0%" as the lower limit value for stopping the pump operation of the low-pressure pump 21. As above, the computer 126 calculates and sets "0%" as the first duty ratio "R0".

As above, it is possible to stop the pump operation of the low-pressure pump 21 without turning off the relay device 35, when the engine operation is temporarily going to be stopped. Namely, it is possible to reduce the number of the on-off operation of the relay device 35, when compared with the prior art. Accordingly, it is possible to suppress occurrence of the breakdown of the relay device 35.

As above, even when the operation of the engine 20 is going to be stopped in the condition that the ignition switch is in the turned-on condition, the relay device 35 is not turned off. Therefore, the FPC 12 is continuously working even during the engine-stopped period in which the engine operation is temporarily stopped. As a result, the FPC 12 can continuously obtain the information for the actual fuel pressure even during the engine-stopped period. In addition, since the feedback control for the fuel pressure is continuously carried out during the engine-stopped period, it is possible to properly operate the low-pressure pump 21 even when the actual fuel pressure is decreased due to, for example, a leakage of the fuel. Furthermore, it is possible to improve a re-starting performance for the low-pressure pump 21, because it is not necessary to carry out an initialization process or the like, which is generally done at a power-on timing when re-starting the pump operation of the low-pressure pump 21.

Figure 5:
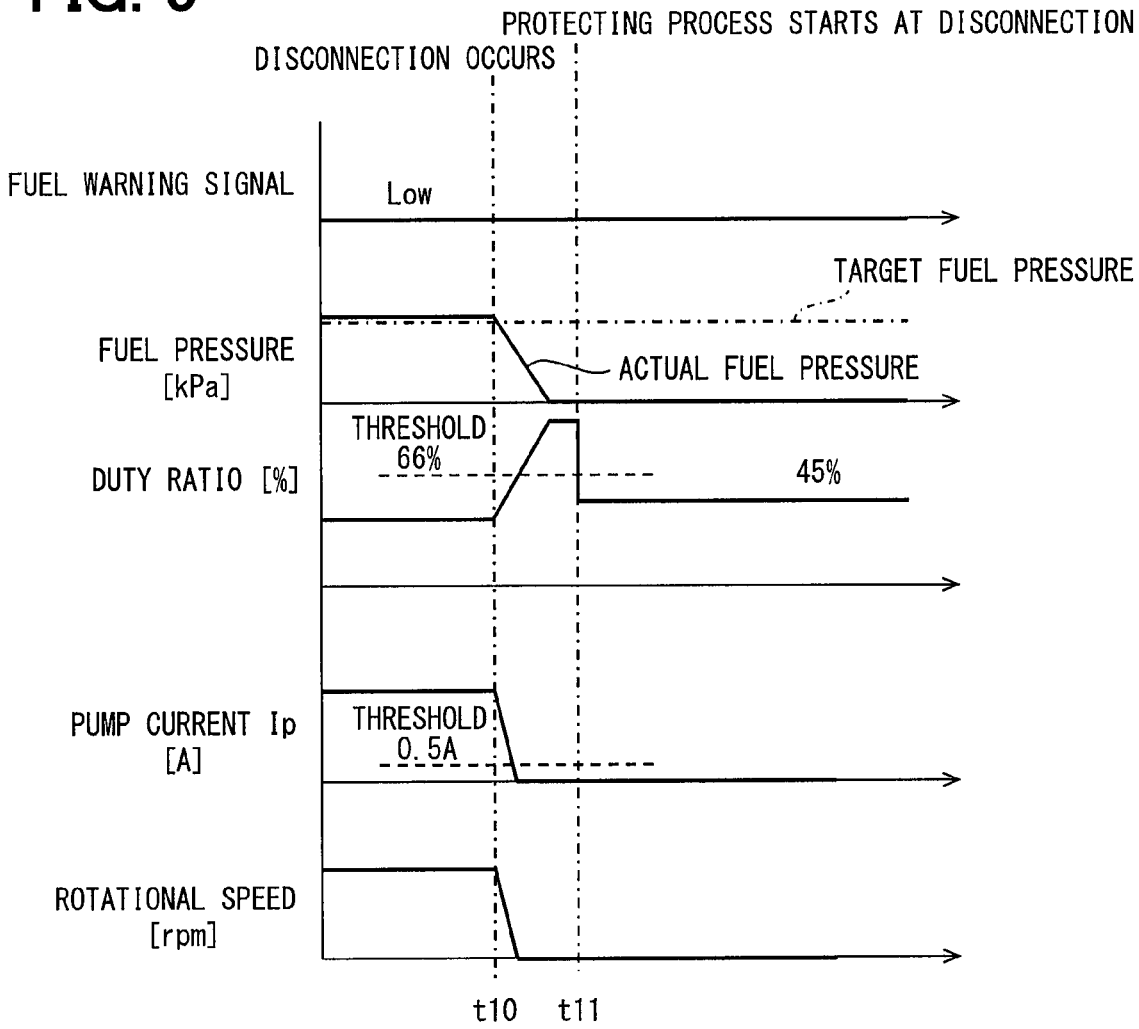
FIG. 5 is a timing chart showing the operational changes of the related parameters in an abnormal condition caused by a wire disconnection.
Figure 6:
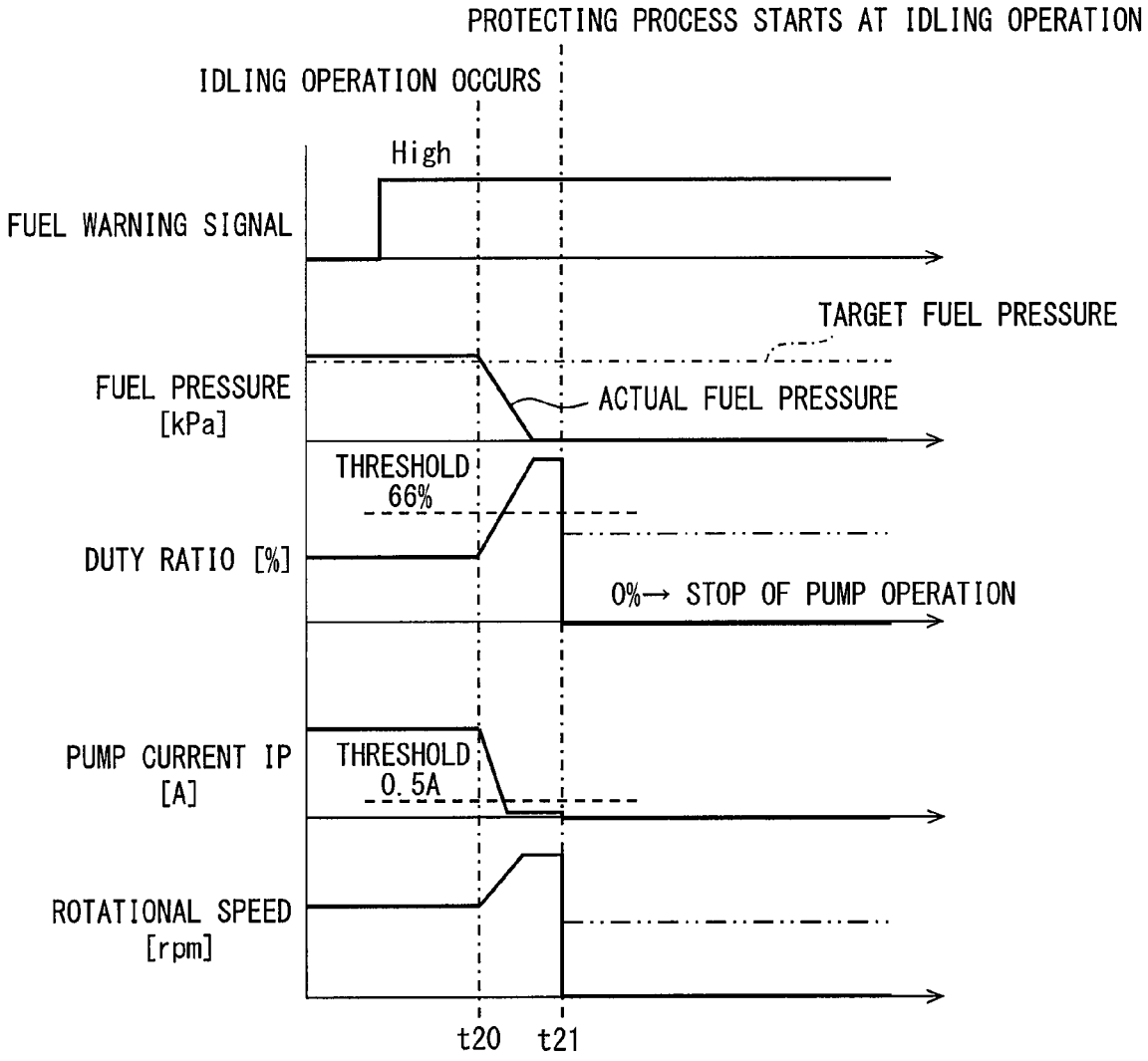
FIG. 6 is a timing chart showing the operational changes of the related parameters in an abnormal condition caused by an idling operation of a fuel pump due to fuel shortage.

FIG. 5 is a timing chart in a case that the abnormal condition is caused by the disconnection. FIG. 6 is a timing chart in a case that the low-pressure pump 21 runs idle due to the shortage of the fuel. In each of FIG. 5 and FIG. 6, the actual fuel pressure is indicated by a solid line, while the target fuel pressure is indicated by a one-dot-chain line. In addition, in each of FIG. 5 and FIG. 6, a rotational speed of the low-pressure pump 21 is indicated as a pro forma amount. In FIG. 6, a pro forma line for the rotational speed is indicated by a two-dot-chain line, in a case that a protecting process (explained below) at the determination of the idling operation of the low-pressure pump 21 is not carried out, namely in a case that the abnormal condition is erroneously detected not as the shortage of the fuel (the idling operation) but as the disconnection of the power supply path.

As shown in FIG. 5, when the disconnection occurs in the power supply path, for example, in the load line 211 at a timing "t10", the electric power supply to the low-pressure pump 21 is cut off. The pump current "Ip" is decreased and finally the pump current "Ip" no longer flows. The rotational speed of the low-pressure pump 21 is correspondingly decreased and the operation of the low-pressure pump 21 is stopped. Then, the actual fuel pressure is decreased due to the operation stop of the low-pressure pump 21. Since a difference between the actual fuel pressure and the target fuel pressure becomes larger, the first duty ratio "R0" is increased. The solid line in FIG. 5 for the duty ratio until the timing "t11" indicates the change of the first duty ratio "R0".

When the pump current "Ip" becomes lower than the current threshold value (for example, 0.5 A) and when the first duty ratio "R0" becomes larger than the duty-ratio threshold value (for example, 66%), the computer 126 determines at a timing between "t10" and "t11" that there occurred the abnormal condition (YES at the step S24 in FIG. 3). Since the fuel warning signal is in the low level in the case of FIG. 5, the computer 126 finally determines that the abnormal condition is caused by the disconnection in the power supply path. Then, the computer 126 starts the protecting process for the case of the disconnection (hereinafter, the pump-disconnection protecting process) at the timing "t11", after the determination of the disconnection is done at the timing between "t10" and "t11". The computer 126 sets the predetermined value (for example, 45%) as the second duty ratio "R1" at the timing "t11" (or before the timing "t11"). The solid line for the duty ratio after the timing "t11" indicates the second duty ratio "R1".

As explained in connection with the step S32 of FIG. 3, the computer 126 sets the predetermined value (for example, 45%) as the second duty ratio "R1", which could maintain the operation of the low-pressure pump 21 if there were no disconnection. This is done as the pump-disconnection protecting process for protecting the pump operation in the abnormal condition, which may be caused by a temporal disconnection of the power supply path. The value of "45%" is continuously set as the second duty ratio "R1", so long as the computer 126 determines the occurrence of the disconnection. In other words, the second duty ratio "R1" is not changed to "0%", even when the disconnection occurs. It is thereby possible to immediately re-start the normal pump operation of the low-pressure pump 21, when the power supply condition returns from the disconnected condition to a normal condition for supplying the electric power to the low-pressure pump 21. As above, it is possible to avoid an engine stall, in a case that the power supply path is temporarily disconnected.

The second duty ratio "R1" at the step S32 for the pump-disconnection protecting process is not limited to "45%". The second duty ratio "R1" may be set at the lower limit value (for example, 33%) for the normal pump operation. The second duty ratio "R1" at the step S32 is preferably set at such a value higher than the lower limit value (set at the steps S16 or S18 of FIG. 3) but as smaller as possible (for example, smaller than "50%").

As shown in FIG. 6, when the low-pressure pump 21 runs idle due to the shortage of the fuel at a timing "t20" (YES at the step S28), the actual fuel pressure is decreased because of the shortage of the fuel. The difference between the actual fuel pressure and the target fuel pressure becomes larger and thereby the first duty ratio "R0" is increased. Since the fuel is running short, the low-pressure pump 21 is rotated at a higher speed (runs idle) and outputs a low torque. Since the torque is not sufficiently outputted in the low-pressure pump 21, the pump current "Ip" is decreased. As explained below more in detail, the computer 126 sets the first duty ratio "R0" calculated at the step S20 as the second duty ratio "R1" before a timing "t21".

As above, each of the actual fuel pressure, the duty ratio and the pump current Ip is changed in a similar manner to those of the case (FIG. 5), in which the disconnection occurs.

When the pump current "Ip" becomes lower than the current threshold value (for example, 0.5 A) and when the first duty ratio "R0" becomes larger than the duty-ratio threshold value (for example, 66%), the computer 126 determines that there occurred the abnormal condition (YES at the step S24 of FIG. 3). Since the fuel warning signal is in the high level in the case of FIG. 6, the computer 126 finally determines that the low-pressure pump 21 runs idle due to the shortage of the fuel. The computer 126 starts a protecting process for the case of the idling operation of the low-pressure pump 21 (hereinafter, the pump-idling protecting process) at the timing "t21".

In the pump-idling protecting process, that is, in the step S30 of FIG. 3, the computer 126 sets a predetermined value (for example, 0%) as the second duty ratio "R1" for stopping the operation of the low-pressure pump 21. The value of "0%" is continuously set as the second duty ratio "R1", so long as the computer 126 determines that the low-pressure pump 21 runs idle due to the shortage of the fuel.

In FIG. 6, the solid line for the duty ratio before the timing "t21" indicates the first duty ratio "R0", while the solid line after the timing "t21" indicates the second duty ratio "R1". In addition, the two-dot-chain line for the duty ratio after the timing "t21" indicates the second duty ratio "R1" in the case of the abnormal condition caused by the disconnection (corresponding to the solid line for the duty ratio in FIG. 5).

As above, in the present embodiment, the pump-disconnection protecting process (FIG. 5) for the case of the disconnection and the pump-idling protecting process (FIG. 6) for the case of the idling operation are separately carried out depending on the type of the abnormal condition, so that it is possible to stop the operation of the low-pressure pump 21 in the case of the idling operation thereof due to the shortage of the fuel. It is thereby possible to avoid a situation that the abnormal condition of the idling operation in the low-pressure pump 21 is erroneously determined as the abnormal condition of the disconnection. Namely, it is possible to avoid a situation that the second duty ratio "R1" is continuously set at the value of "45%" (indicated by the two-dot-chain line in FIG. 6). In other words, it is possible to avoid the situation that the idling operation of the low-pressure pump 21 may be maintained as a result that the abnormal condition caused by the fuel shortage is erroneously determined as the abnormal condition caused by the disconnection. Accordingly, it is possible to prevent the idling operation of the low-pressure pump 21 from being continued by and after the erroneous determination of the abnormal condition.

The present disclosure is not limited to the above embodiment but can be modified in the following manners.

In the above embodiment, the high-pressure pump 26 is arranged between the low-pressure pump 21 and the engine 20, more exactly, between the low-pressure pump 21 and the fuel delivery pipe 24. The present disclosure is not limited to the above arrangement of the high-pressure pump 26.

In the above embodiment, the on-off operation of the relay device 35 is controlled by the engine ECU 11. The relay device 35 may be directly turned on or off, when the ignition switch is turned on or off.

In the above embodiment, the FPC 12 obtains the fuel warning signal from the meter ECU 13. However, the fuel warning signal may be inputted at first to the engine ECU 11 and then transmitted from the engine ECU 11 to the FPC 12. Alternatively, the detection signal of the fuel sensor 23 may be inputted to the FPC 12 and the FPC 12 may determine the idling operation of the low-pressure pump 21 due to the shortage of the fuel based on the detection signal of the fuel sensor 23. Furthermore, the detection signal of the fuel sensor 23 may be inputted to the engine ECU 11 and the information relating to the remaining fuel amount may be outputted from the engine ECU 11 to the FPC 12.

In the above embodiment, the FPC 12 and the fuel supply system 10 including the FPC 12 are applied to the automotive vehicle having the idling-stop function. The present disclosure may be applied to a hybrid vehicle, which has an electric motor as a vehicle driving device in addition to the engine 20. In such a case, "0%" is set as the lower limit value for the duty ratio for the pump driving signal when the vehicle is running in an EV running mode in which the engine operation is stopped, while "33%" is set as the lower limit value for the duty ratio in a vehicle running mode other than the EV running mode. As above, the duty ratio for stopping the operation of the low-pressure pump 21 is set as the lower limit value, when the pump operation is going to be stopped in the condition that the ignition switch is in the on-condition, namely, when the engine operation is temporarily going to be stopped during the running of the vehicle.

In the above embodiment, the FPC 12 includes the computer 126 which carries out the above explained processes. However, the functions and/or means provided by the FPC 12 can be alternatively provided by a software memorized in a memory device and a computer for executing the software, by a software alone, by a hardware alone, or by a combination thereof. In a case that the engine ECU 11 is provided by electronic circuits of the hardware, the engine ECU 11 is composed of digital circuits or analog circuits including multiple logic circuits.

The present disclosure is not limited to the above embodiment and/or modifications but can be further modified in various manners without departing from a spirit of the present disclosure.

What is claimed is:

1. A fuel pump control system for an internal combustion engine mounted in an automotive vehicle comprising:

a relay device for supplying electric power from a vehicle battery to a fuel pump when the relay device is turned on, so that the fuel pump supplies fuel from a fuel tank to the internal combustion engine;

a switching device provided in a power supply path for supplying the electric power to the fuel pump and connected in series with the fuel pump, the switching device being turned on or turned off depending on a pump driving signal;

an information obtaining portion for obtaining an information relating to an actual fuel pressure of the fuel pumped out from the fuel pump, an information relating to a target fuel pressure for controlling the fuel pump, an information relating to an engine operating condition of the internal combustion engine and an information relating to a remaining amount of the fuel in the fuel tank;

a calculation portion for calculating a first duty ratio of the pump driving signal based on the actual fuel pressure, the target fuel pressure and the engine operating condition, wherein the calculation portion calculates a predetermined value as the first duty ratio with which a pump operation of the fuel pump is stopped in a case that the engine operating condition is in an engine stopped mode while an ignition switch is in a turned-on condition; and a determination portion for determining an abnormal condition relating to the fuel pump, in such a way that the abnormal condition to be caused by a disconnection in the power supply path and the abnormal condition to be caused by an idling operation of the fuel pump due to shortage of the fuel are discriminated from each other depending on the information relating to the remaining amount of the fuel in the fuel tank.

2. The fuel pump control system according to claim 1, wherein the calculation portion comprises;

a lower-limit setting portion for setting a lower limit value for the first duty ratio of the pump driving signal depending on the engine operating condition, wherein the lower-limit setting portion sets the predetermined value as the lower limit value for stopping the pump operation, in a case that the engine operation is going to be stopped in a condition that the ignition switch is turned on; and a duty-ratio calculating portion for calculating the first duty ratio of the pump driving signal, so that a feedback control is carried out by use of the first duty ratio and the lower limit value in order that the actual fuel pressure comes closer to the target fuel pressure.

3. The fuel pump control system according to claim 1, wherein the information obtaining portion obtains an information relating to pump current flowing through the fuel pump, and a first part of the determination portion determines whether there is the abnormal condition or not, based on the pump current obtained by the information obtaining portion and the first duty ratio calculated by the calculation portion, and a second part of the determination portion further determines, when the first part of the determination portion determines that there is the abnormal condition, whether the abnormal condition is caused by the disconnection in the power supply path or the abnormal condition is caused by the idling operation of the fuel pump due to the shortage of the fuel in the fuel tank.

4. The fuel pump control system according to claim 1, further comprising;

a duty-ratio setting portion for setting a second duty ratio of the pump driving signal depending on a determination result of the determination portion.

5. The fuel pump control system according to claim 4, wherein the duty-ratio setting portion sets a predetermined duty ratio as the second duty ratio, with which the pump operation of the fuel pump is stopped, when the abnormal condition is caused by the idling operation of the fuel pump.

6. The fuel pump control system according to claim 4, wherein the duty-ratio setting portion sets another predetermined duty ratio as the second duty ratio with which the pump operation of the fuel pump can be maintained, and the pump driving signal having the second duty ratio is continuously applied to the switching device, when the abnormal condition is caused by the disconnection in the power supply path.

7. The fuel pump control system according to claim 4, wherein the duty-ratio setting portion sets the first duty ratio calculated in the calculation portion as the second duty ratio, when there is no abnormal condition.

8. A fuel pump control system for an internal combustion engine mounted in an automotive vehicle comprising:

a relay device for supplying electric power from a vehicle battery to a fuel pump when the relay device is turned on, so that the fuel pump supplies fuel from a fuel tank to the internal combustion engine;

a switching device provided in a power supply path for supplying the electric power to the fuel pump and connected in series with the fuel pump, the switching device being turned on or turned off depending on a pump driving signal; and an electronic control unit for calculating a first duty ratio for the pump driving signal based on a target fuel pressure, an actual fuel pressure and an engine operating mode, to carry out a feedback control with the first duty ratio so that the actual fuel pressure comes closer to the target fuel pressure, the electronic control unit determining whether there is an abnormal condition in an operation of the fuel pump, based on the first duty ratio for the feedback control and pump current flowing through the fuel pump, the electronic control unit further determining whether the abnormal condition is caused by a disconnection in the power supply path for the fuel pump or whether the abnormal condition is caused by an idling operation of the fuel pump due to shortage of the fuel, based on information relating to a remaining fuel amount in the fuel tank, the electronic control unit calculating a first predetermined value and sets the first predetermined value as a second duty ratio, when it determines that the abnormal condition is caused by the idling operation of the fuel pump due to the shortage of the fuel, so that the operation of the fuel pump is stopped with the pump driving signal having the second duty ratio of the first predetermined value, and the electronic control unit calculating a second predetermined value and sets the second predetermined value as the second duty ratio, when it determines that the abnormal condition is caused by the disconnection in the power supply path, so that the pump driving signal having the second duty ratio of the second predetermined value is continuously applied to the switching device, wherein the second predetermined value is larger than the first predetermined value.

* * * * *